US011071388B2

(12) United States Patent
Leng

(10) Patent No.: US 11,071,388 B2
(45) Date of Patent: Jul. 27, 2021

(54) FOLDABLE CHAIR

(71) Applicant: New-Tec Integration (Xiamen) Co., Ltd., Xiamen (CN)

(72) Inventor: Luhao Leng, Xiamen (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 0 days.

(21) Appl. No.: 17/007,160

(22) Filed: Aug. 31, 2020

(65) Prior Publication Data

US 2021/0059414 A1 Mar. 4, 2021

(30) Foreign Application Priority Data

Aug. 30, 2019 (CN) ..... 201921442318.X

(51) Int. Cl.
*A47C 4/18* (2006.01)
*A47C 4/04* (2006.01)
*A47C 3/40* (2006.01)

(52) U.S. Cl.
CPC . *A47C 4/04* (2013.01); *A47C 3/40* (2013.01)

(58) Field of Classification Search
CPC .... A47C 4/04; A47C 4/00; A47C 4/24; A47C 4/02; A47C 4/20; A47C 5/10; A47C 4/48; A47C 4/18
USPC ..... 297/16.1
See application file for complete search history.

(56) References Cited

U.S. PATENT DOCUMENTS 2,666,478 A * 1/1954 Shwayder ..... A47C 5/04 297/58
2,757,715 A * 8/1956 Hendrickson ..... A47C 4/24 297/58
4,298,227 A * 11/1981 Berthier ..... A47C 4/14 297/58
4,309,057 A * 1/1982 Lindley ..... A47C 4/04 297/239
4,536,026 A * 8/1985 Cornell ..... A47C 5/10 297/39
5,536,063 A * 7/1996 Cable ..... A47C 4/02 297/16.2
5,634,684 A * 6/1997 Kojima ..... A47C 4/24 297/58
6,131,992 A * 10/2000 Chang ..... A47C 4/20 297/55
6,279,991 B1 * 8/2001 Atkins ..... A47C 4/24 297/16.1
6,386,627 B1 * 5/2002 Tsai ..... A47C 4/24 297/16.1

(Continued)

*Primary Examiner* — Shin H Kim
(74) *Attorney, Agent, or Firm* — Cooper Legal Group, LLC

(57) ABSTRACT

A foldable chair comprises a chair seat, front leg tubes, rear leg tubes, and two telescopic frames. The two telescopic frames respectively correspond to the front leg tubes and the rear leg tubes. Each of the two telescopic frames comprises two support tubes and a connection tube connected to the two support tubes. The two support tubes of a first of the two telescopic frames are respectively and telescopically coupled with the front leg tubes, and the two support tubes of a second of the two telescopic frames are respectively and telescopically coupled with the rear leg tubes. A locking mechanism is disposed between each of the support tubes and a corresponding one of the front leg tubes and the rear leg tubes.

12 Claims, 11 Drawing Sheets

(56) References Cited

U.S. PATENT DOCUMENTS

| | | | | |
|---|---|---|---|---|
| 6,612,654 | B2 * | 9/2003 | Laws | A47C 4/24 297/218.1 |
| 6,616,223 | B1 * | 9/2003 | Lin | A47C 4/44 297/16.1 |
| 6,709,050 | B2 * | 3/2004 | Huang | A47C 4/18 297/447.2 |
| 6,890,026 | B1 * | 5/2005 | Shin | A47C 4/00 182/33 |
| D533,000 | S * | 12/2006 | Lu | D8/382 |
| 7,219,955 | B2 * | 5/2007 | Lu | A47C 4/20 297/58 |
| 7,300,059 | B2 * | 11/2007 | Caruso | A63B 63/004 273/400 |
| D569,118 | S * | 5/2008 | Lin | D6/368 |
| 7,537,453 | B2 * | 5/2009 | Morgan | A47B 97/00 434/80 |
| D599,127 | S * | 9/2009 | Smith | D6/368 |
| 8,454,093 | B2 * | 6/2013 | Smith | A47C 4/48 297/440.11 |
| 8,496,296 | B2 * | 7/2013 | Fusao | A47C 4/02 297/440.24 |
| 10,292,503 | B2 * | 5/2019 | Brown | A47C 7/008 |
| 2003/0168894 | A1 * | 9/2003 | Lin | A47C 4/48 297/55 |
| 2003/0234562 | A1 * | 12/2003 | Huang | A47C 4/18 297/57 |
| 2003/0234563 | A1 * | 12/2003 | Huang | A47C 4/18 297/58 |
| 2011/0025104 | A1 * | 2/2011 | Fusao | A47C 4/02 297/55 |
| 2016/0081479 | A1 * | 3/2016 | Lin | A47C 4/24 297/16.1 |

* cited by examiner

FOLDABLE CHAIR

RELATED APPLICATIONS

This application claims priority to Chinese patent application number 201921442318.X, filed on Aug. 30, 2019, which is incorporated herein by reference.

FIELD OF THE DISCLOSURE

The present disclosure relates to a foldable chair, and more particularly relates to a telescopic foldable chair with an adjustable height.

BACKGROUND OF THE DISCLOSURE

A foldable chair usually comprises front legs, rear legs, a chair seat hinged between the front legs and the rear legs, and a backrest located above a rear side of the chair seat. When not in use, the foldable chair can be folded so that the front legs and the rear legs are folded together and the chair seat is turned to a generally vertical state for placement, which is beneficial to save the storage space occupied by the chair.

In the existing foldable chair, a distance between the chair seat and the ground is fixed when the foldable chair is in an unfolded state. For shorter people, such as children, their feet are off the ground when sitting on the chair seat, which is uncomfortable and offers no sense of security. For taller people, such as basketball players, a height from their sole to their knee is much higher than the height of the chair seat. When sitting on the chair, their feet bend severely and their sitting posture is very uncomfortable.

Therefore, there is currently a lack of foldable chairs with an adjustable height of the chair seat.

BRIEF SUMMARY OF THE DISCLOSURE

The present disclosure provides a foldable chair, which can telescopically adjust a height of the chair seat. In order to solve the aforementioned technical problem, a technical solution of the present disclosure is as follows.

A foldable chair comprises a chair seat, front leg tubes symmetrically disposed on a left side and a right side of the chair seat, rear leg tubes symmetrically disposed on the left side and the right side of the chair seat, and two telescopic frames. Each of the front leg tubes and a corresponding one of the rear leg tubes disposed on a same side of the chair seat are pivotally connected together. The front leg tubes and the rear leg tubes support the chair seat and enable the chair seat to be turned over and to be folded. The two telescopic frames respectively correspond to the front leg tubes and the rear leg tubes. Each of the two telescopic frames comprises two support tubes and a connection tube connected to the two support tubes. The two support tubes of a first of the two telescopic frames are respectively and telescopically coupled with the front leg tubes, and the two support tubes of a second of the two telescopic frames are respectively and telescopically coupled with the rear leg tubes. A locking mechanism is disposed between each of the support tubes and a corresponding one of the front leg tubes and the rear leg tubes that be coupled with a corresponding one of the support tubes.

Compared with the existing techniques, the technical solution has the following advantages.

Telescopic frames are disposed under the two front leg tubes and the two rear leg tubes. Since the front leg tubes and the rear leg tubes are coupled with the support tube of the telescopic frame, in a normal state, the support tubes and the leg tubes are locked together by the locking mechanisms. When the height of the chair seat needs to be adjusted, after unlocking the locking mechanisms, the support tubes and the leg tubes coupled with the support tubes can be moved relative to one another, so that the ground clearance of the front leg tubes and the rear leg tubes can be adjusted so as to adjust the height of the chair seat. Therefore, it is very convenient for children.

BRIEF DESCRIPTION OF THE DRAWINGS

The present disclosure will be further described below in combination with the accompanying drawings and embodiments.

DETAILED DESCRIPTION OF THE EMBODIMENTS

Embodiment 1

Figure 1:
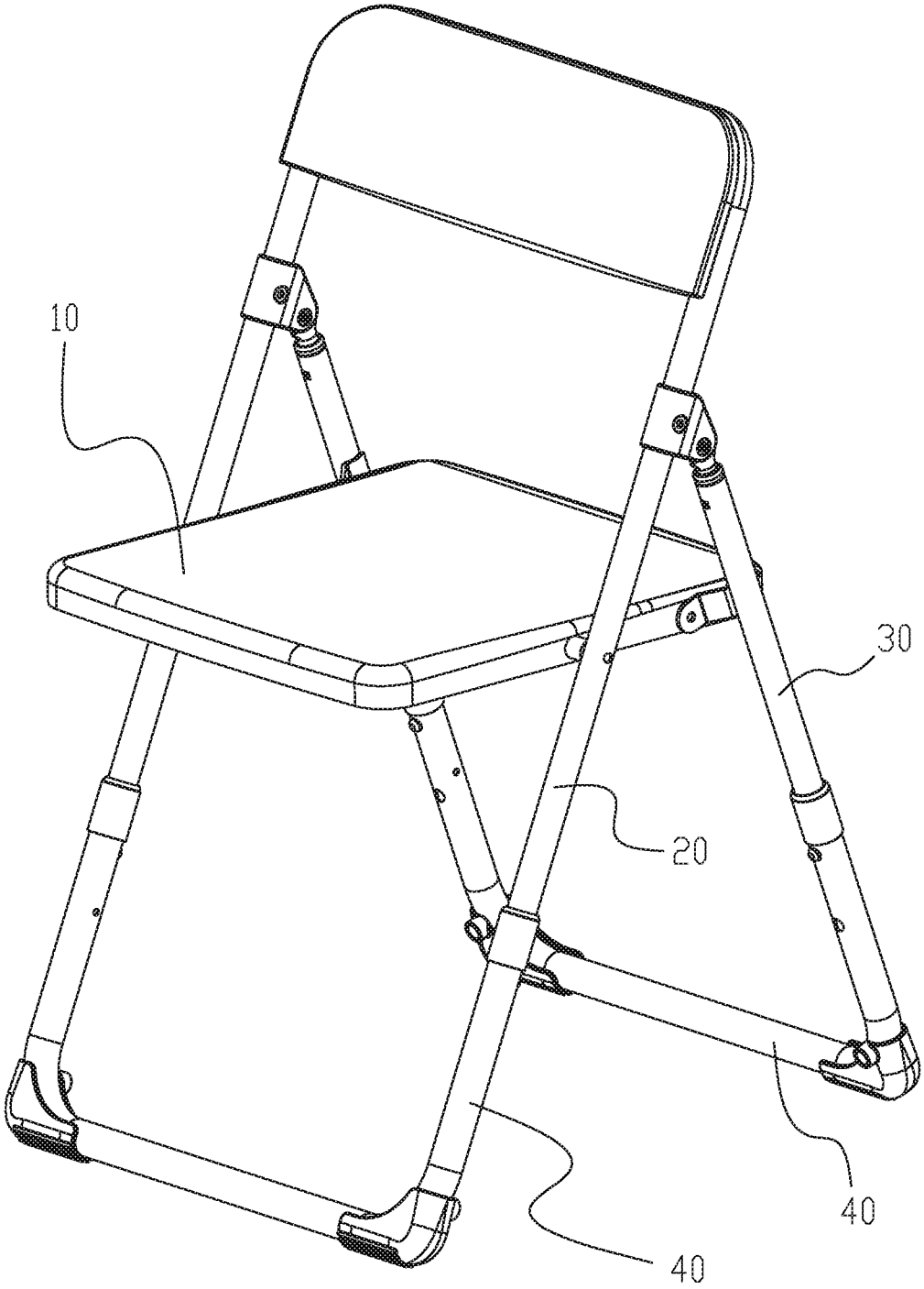
FIG. 1 illustrates a perspective view of a foldable chair of Embodiment 1 of the present disclosure.
Figure 2:
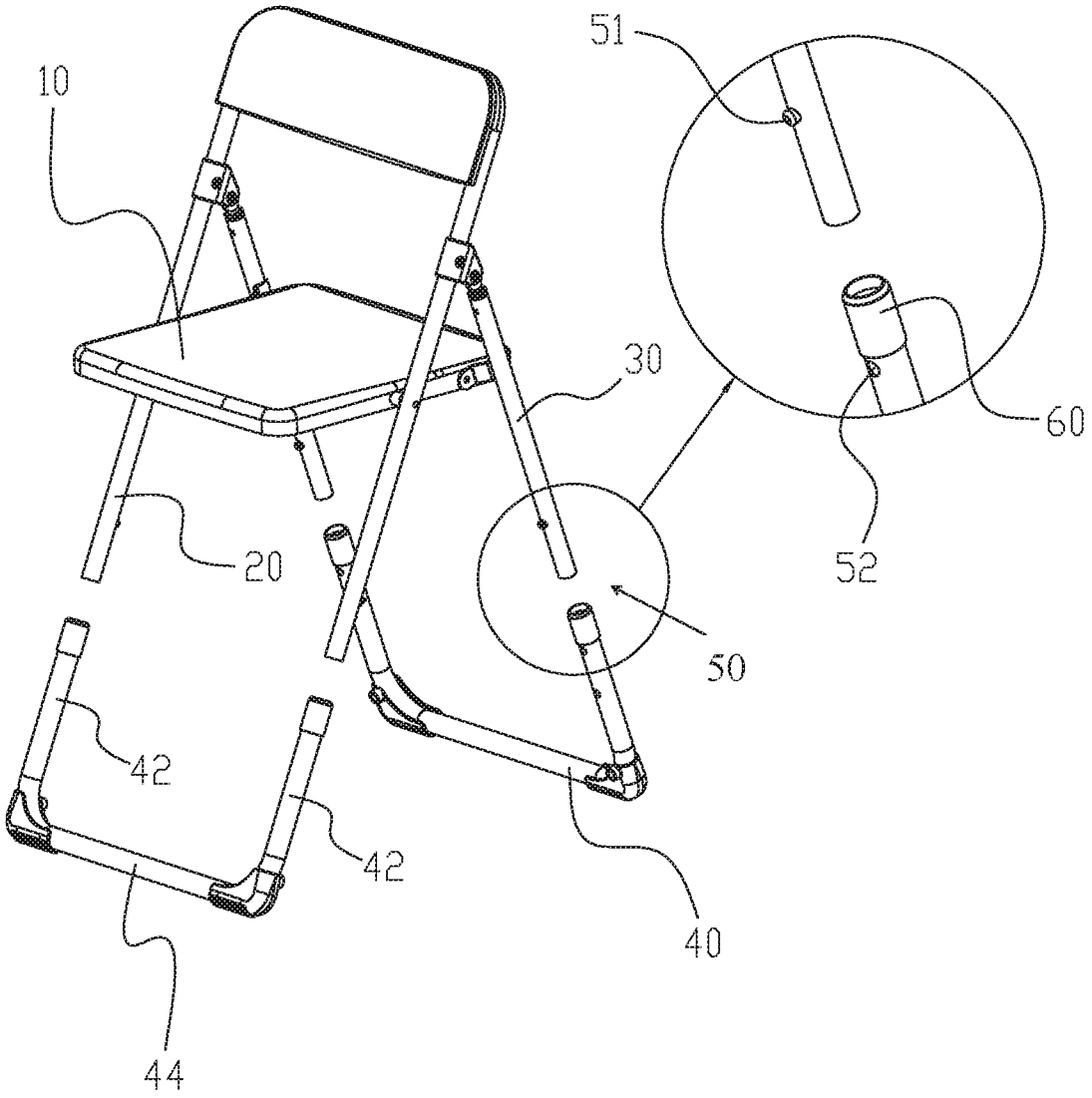
FIG. 2 illustrates an exploded view of the foldable chair of FIG. 1.

Referring to FIGS. 1 and 2, a foldable chair comprises a chair seat 10, two front leg tubes 20 symmetrically disposed on a left side and a right side of the chair seat 10, and two rear leg tubes 30 symmetrically disposed on the left side and the right side of the chair seat 10. A front leg tube 20 and a corresponding one of the two rear leg tubes 30 disposed on a same side of the chair seat 10 are pivotally connected together. The two front leg tubes 20 and the two rear leg tubes 30 support the chair seat 10 and enable the chair seat 10 to be turned over and to be folded. The aforementioned structure is the same as conventional foldable chair structures and will not be described in detail. The foldable chair also comprises two telescopic frames 40 respectively corresponding to the two front leg tubes 20 and the two rear leg tubes 30. Each of the two telescopic frames 40 comprises two support tubes 42 and a connection tube 44 connected to the two support tubes 42. The two support tubes 42 of a first of the two telescopic frames 40 are respectively and telescopically plugged with the two front leg tubes 20, and the two support tubes 42 of a second of the two telescopic frames 40 are respectively and telescopically plugged with the two rear leg tubes 30. A locking mechanism 50 is disposed between each of the support tubes 42 and a corresponding one of the leg tubes (the two front leg tubes 20 and the two rear leg tubes 30) that plugs a corresponding one of the support tubes 42, and the locking mechanism 50 functions to enable each of the support tubes 42 to be fixedly connected to the corresponding one of the leg tubes that plugs the corresponding one of the support tubes 42. In a normal state, the support tubes 42 are locked to the leg tubes that plug the support tubes 42 by the locking mechanisms 50, so that a height of the chair seat 10 remains unchanged. If the height of the chair seat 10 needs to be adjusted, the locking mechanisms 50 are unlocked, and the support tubes 42 are configured to telescopically move relative to the leg tubes that plug the support tubes 42.

In this embodiment, each of the locking mechanisms 50 comprises an elastic protrusion ball head 51 and one or more first lock holes 52. The two front leg tubes 20 and the two rear leg tubes 30 are narrow, the support tubes 42 are wide (e.g., a diameter of each of the two front leg tubes 20 and each of the two rear leg tubes 30 is smaller than a diameter of a corresponding one of the support tubes 42), and the leg tubes (the two front leg tubes 20 and the two rear leg tubes 30) are disposed in the support tubes 42. Each of the elastic protrusion ball heads 51 is disposed on a corresponding one of the leg tubes. In some embodiments, the one or more first lock holes 52 comprises multiple first lock holes 52, and the one or more first lock holes 52 are disposed on a corresponding one of the support tubes 42 at intervals along a length direction of the corresponding one of the support tubes 42. In a locked state, each of the elastic protrusion ball heads 51 is locked into a corresponding one of the one or more first lock holes 52. When the supports tubes 42 are to be unlocked from the leg tubes, the elastic protrusion ball heads 51 are pressed to separate the elastic protrusion ball heads 51 from the one or more first lock holes 52, so that a depth of the leg tubes disposed in the support tubes 42 can be adjusted so as to adjust the height of the chair seat 10. When the height of the chair seat 10 is adjusted to a required height, the elastic protrusion ball heads 51 are locked to first lock holes of the one or more first lock holes 52 with a corresponding height, and the supports tubes 42 are once again locked to the leg tubes.

It is apparent that each of the locking mechanisms 50 can enable a height of the chair seat 10 to remain constant during use provided that a corresponding one of the support tubes 42 is locked to a corresponding one of the leg tubes. Therefore, each of the locking mechanisms 50 can be a positioning pin and a pin hole, respectively disposed on a corresponding one of the support tubes 42 and a corresponding one of the leg tubes. When the positioning pins pass through the pin holes, each of the support tubes 42 is naturally locked to the corresponding one of the leg tubes. When the positioning pins are pulled out of the support tubes 42, the leg tubes and the support tubes can move telescopically. Alternatively, the locking mechanisms 50 can be threaded bolts screwed to the support tubes 42, and the threaded bolts rotate tightly to enable the leg tubes to be abutted tightly against the support tubes 42.

In some embodiments, upper openings of the support tubes 42 are disposed with guide sleeves 60 configured to facilitate an assembly of the support tubes 42 and the leg tubes.

In this embodiment, the connection tube 44 is connected between lower ends of the two support tubes 42, and the telescopic frame 40 defines a U-shaped support structure.

Embodiment 2

Figure 3:
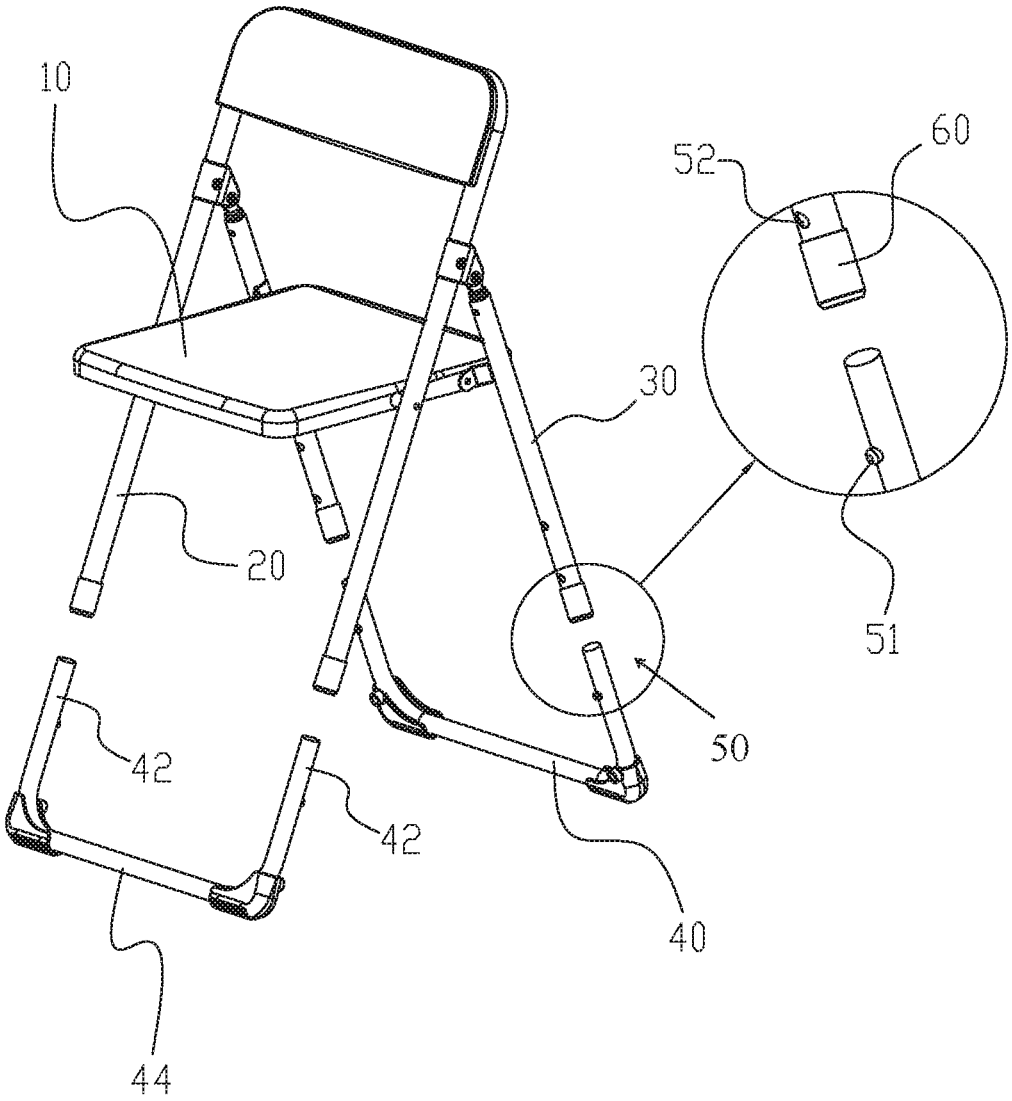
FIG. 3 illustrates an exploded view of a foldable chair of Embodiment 2.

Referring to FIG. 3, Embodiment 2 differs from Embodiment 1 in that the two front leg tubes 20 and the two rear leg tubes 30 are wide, the support tubes 42 are narrow (e.g., the diameter of each of the two front leg tubes 20 and each of the two rear leg tubes 30 is larger than the diameter of a corresponding one of the support tubes 42), and the support tubes 42 are disposed in the leg tubes (the front leg tubes 20 and the rear leg tubes 30). The positions of the elastic protrusion ball heads 51 and the one or more first lock holes 52 are reversed. Each of the elastic protrusion ball heads 51 is disposed on a corresponding one of the support tubes 42, and the one or more first lock holes 52 are disposed on a corresponding one of the leg tubes. Furthermore, the guide sleeves 60 are disposed on lower openings of the leg tubes.

Embodiment 3

Figure 4:
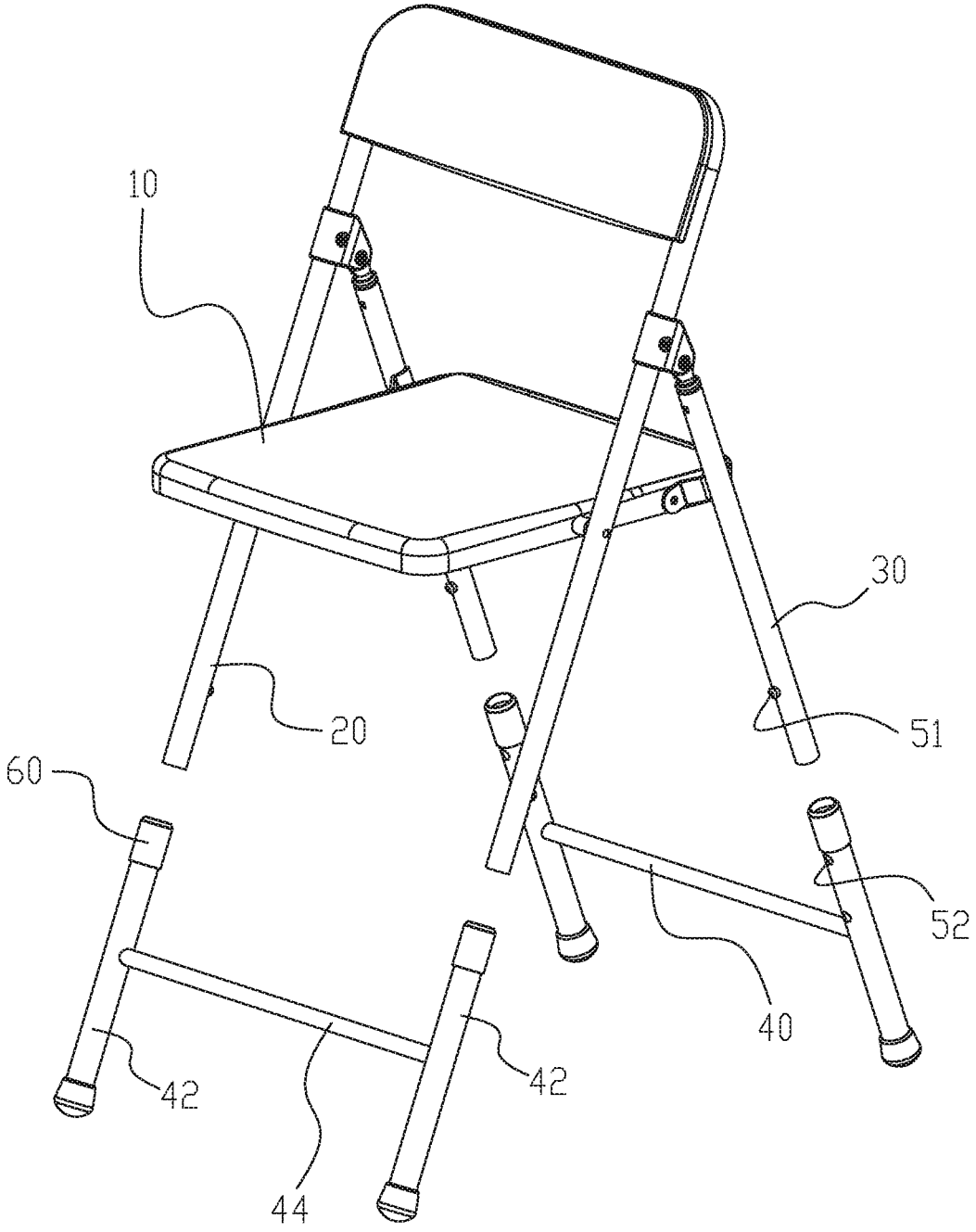
FIG. 4 illustrates an exploded view of a foldable chair of Embodiment 3.
Figure 5:
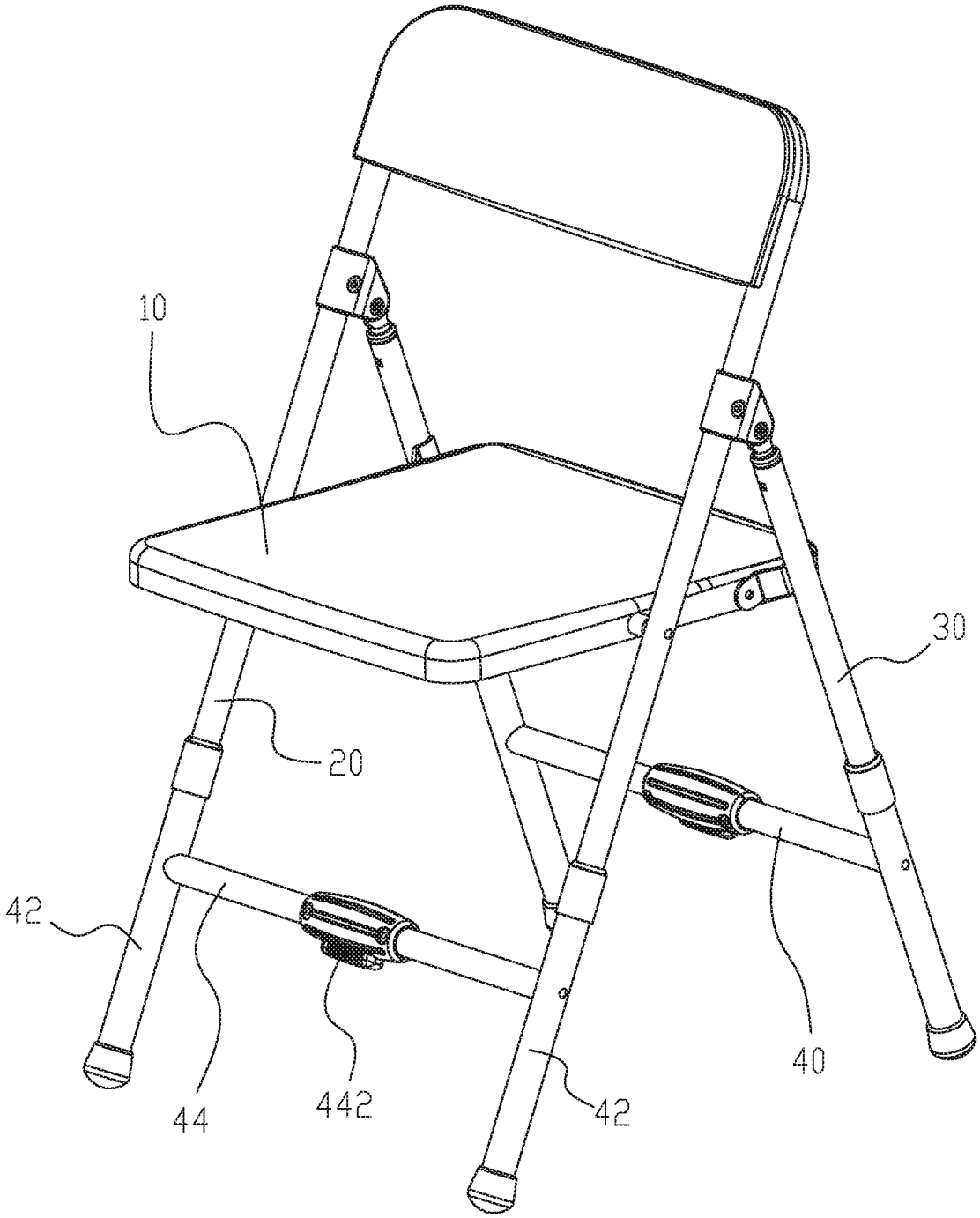
FIG. 5 illustrates a perspective view of a foldable chair of Embodiment 4.
Figure 6:
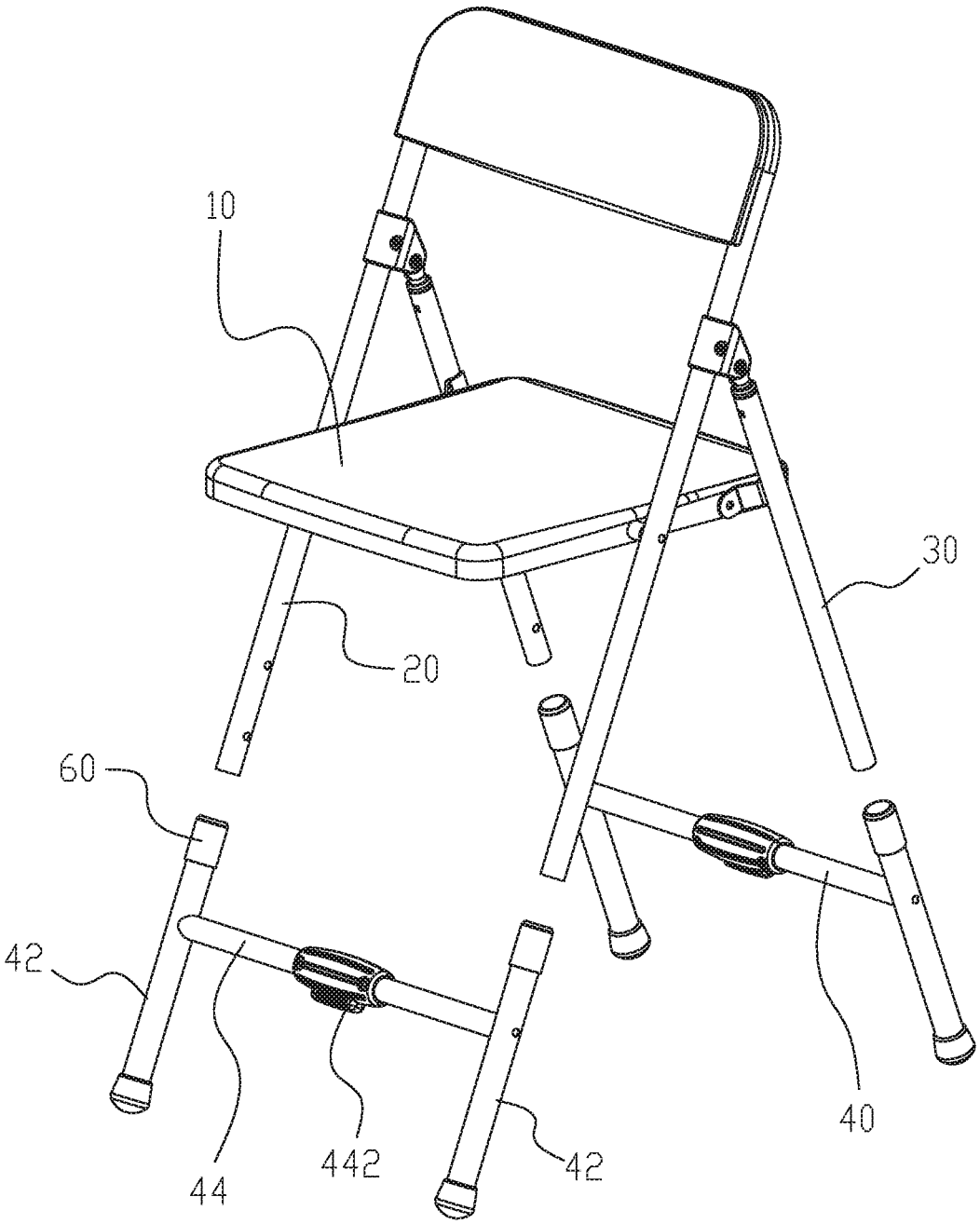
FIG. 6 illustrates an exploded view of the foldable chair of FIG. 5.
Figure 7:
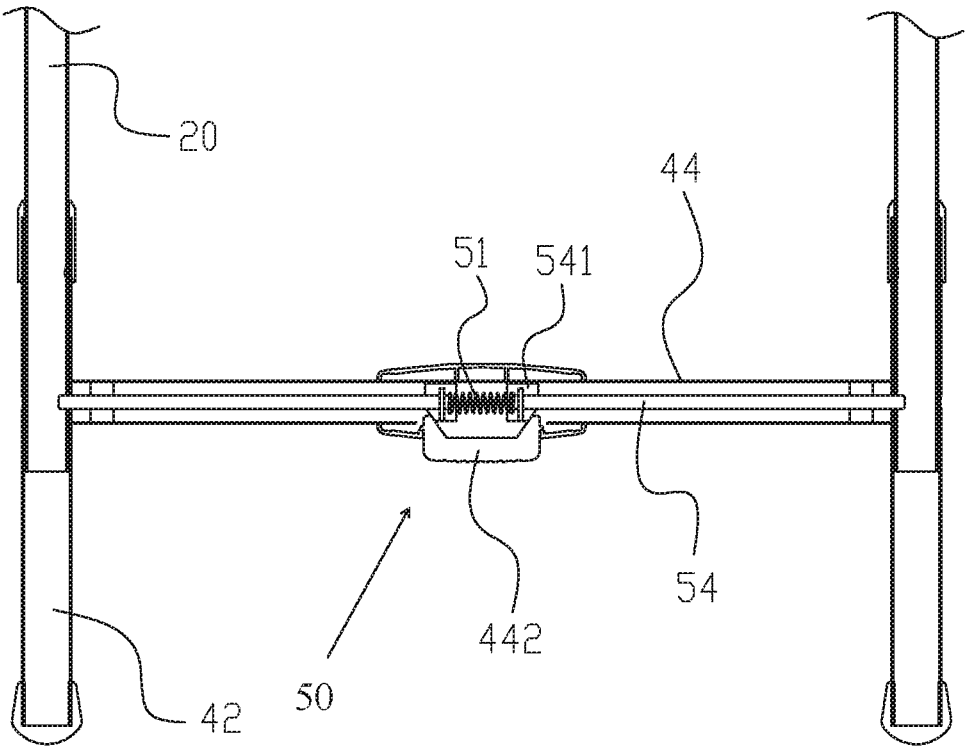
FIG. 7 illustrates a cross-sectional view of a lock rod and a lock hole of the foldable chair of FIG. 5 when in a coupled state in which the lock rod is disposed in the lock hole.
Figure 8:
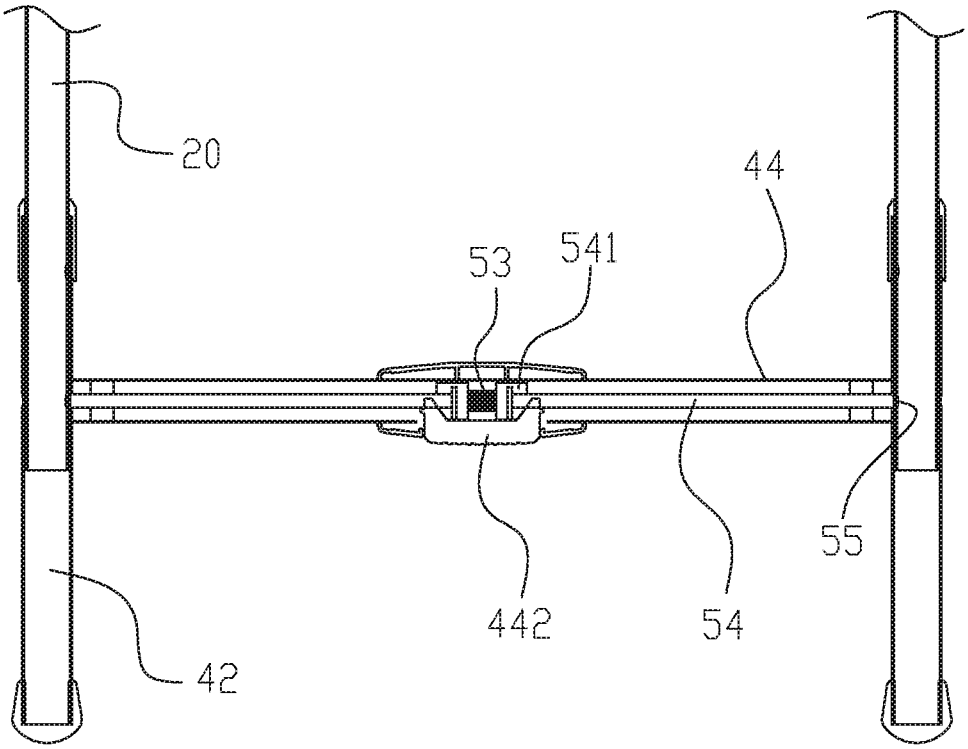
FIG. 8 illustrates a cross-sectional view of the lock rod and the lock hole of the foldable chair of FIG. 5 when in a separated state.

Referring to FIG. 4, Embodiment 3 differs from Embodiment 1 in that the connection tube 44 is connected between middle portions of the two support tubes 42, and the telescopic frame 40 is H-shaped.

Embodiment 4

Referring to FIGS. 5-8, Embodiment 4 differs from Embodiment 3 in that the locking mechanism 50 comprises an elastic member 53, one or more lock rods 54 (e.g., two lock rods), and one or more second lock holes 55. In some embodiments, the one or more second lock holes 55 comprises multiple second lock holes 55, and the one or more second lock holes 55 are disposed on a corresponding one of the leg tubes at intervals along a length direction of the corresponding one of the leg tubes. The one or more lock rods 54 are laterally and movably disposed in the connection tube 44, and the elastic member 53 drives the one or more lock rods 54 to move laterally and outwardly to enable outer ends of the one or more lock rods 54 to be disposed in corresponding second lock holes 55 of the one or more second lock holes 55. The one or more lock rods 54 are connected between the telescopic frame 40 and the leg tubes to enable the leg tubes to be fixed. When the leg tubes are to be unlocked from the support tubes 42, the one or more lock rods 54 are pulled out to separate the one or more lock rods 54 from the one or more second lock holes 55, and the leg tubes can move telescopically relative to the support tubes 42.

In some embodiments, inner ends of the one or more lock rods 54 are disposed with sliders 541, and a middle portion of the connection tube 44 is disposed with a button 442 configured to move radially. The button 442 and the sliders 541 are disposed with inclined surfaces facing each other, and the buttons 442 are pressed to pull the one or more lock rods 54 to move laterally and inwardly, thereby an unlocking operation is achieved.

Embodiment 5

Figure 9:
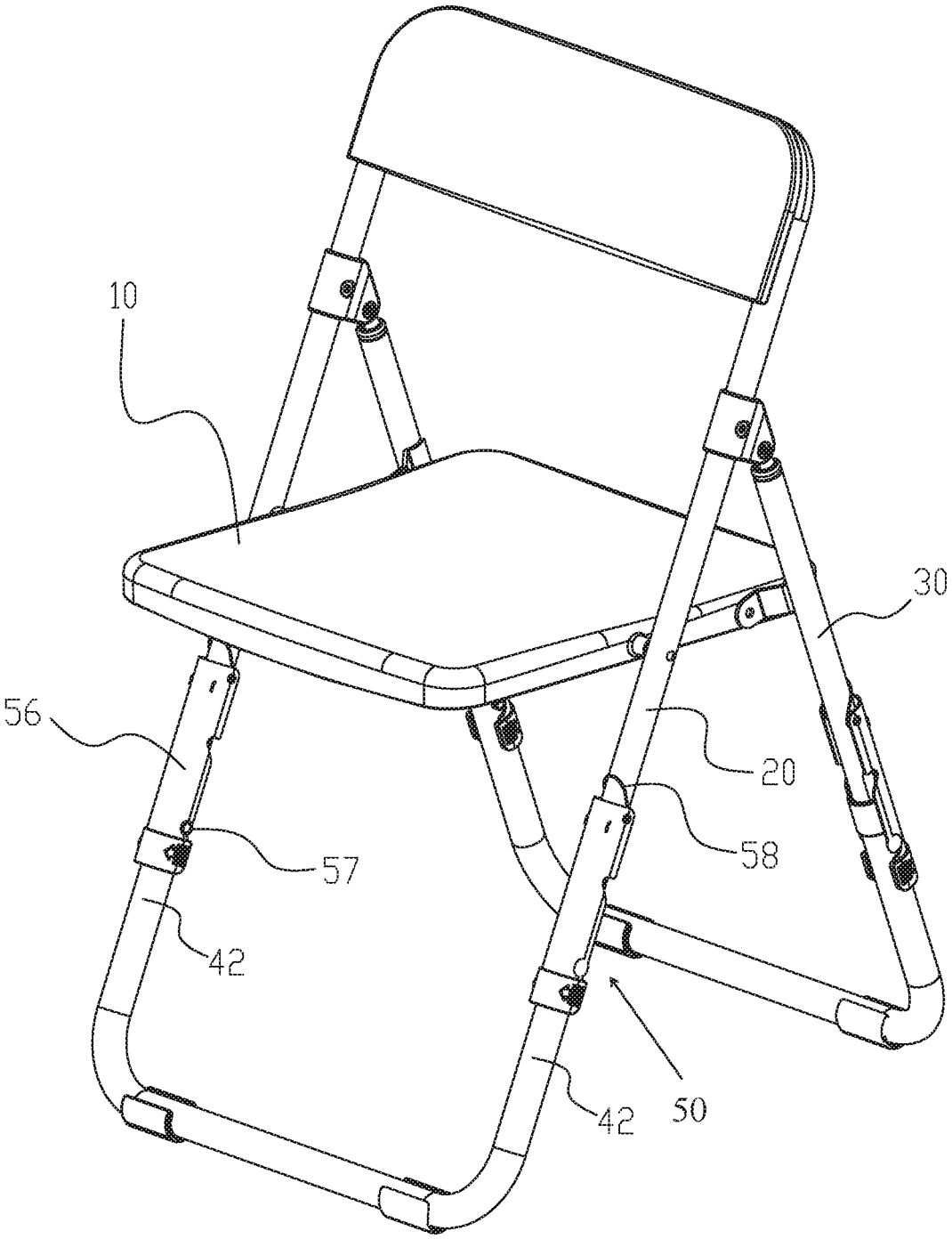
FIG. 9 illustrates a perspective view of a foldable chair of Embodiment 5.
Figure 10:
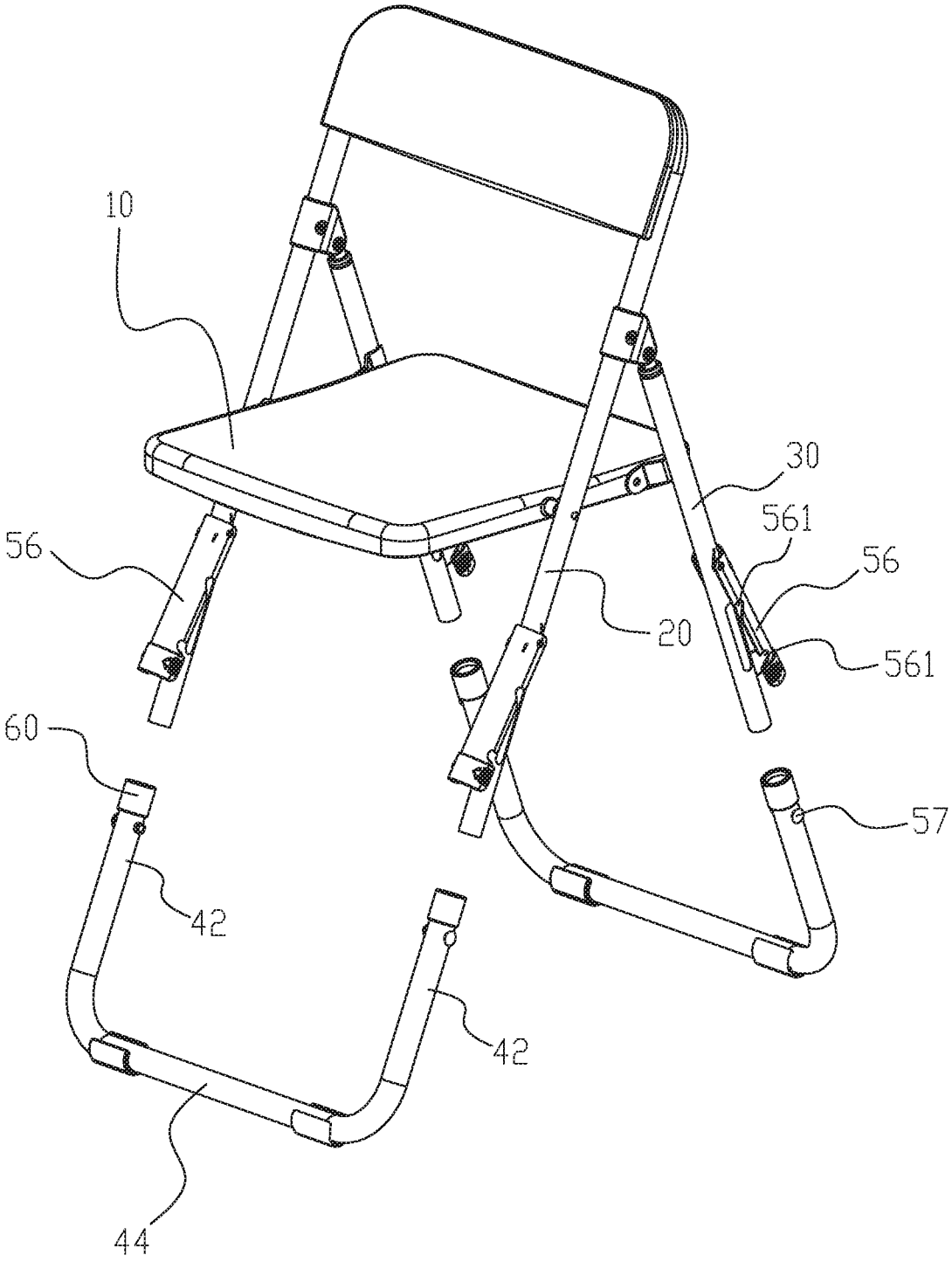
FIG. 10 illustrates an exploded view of the foldable chair of FIG. 9.
Figure 11:
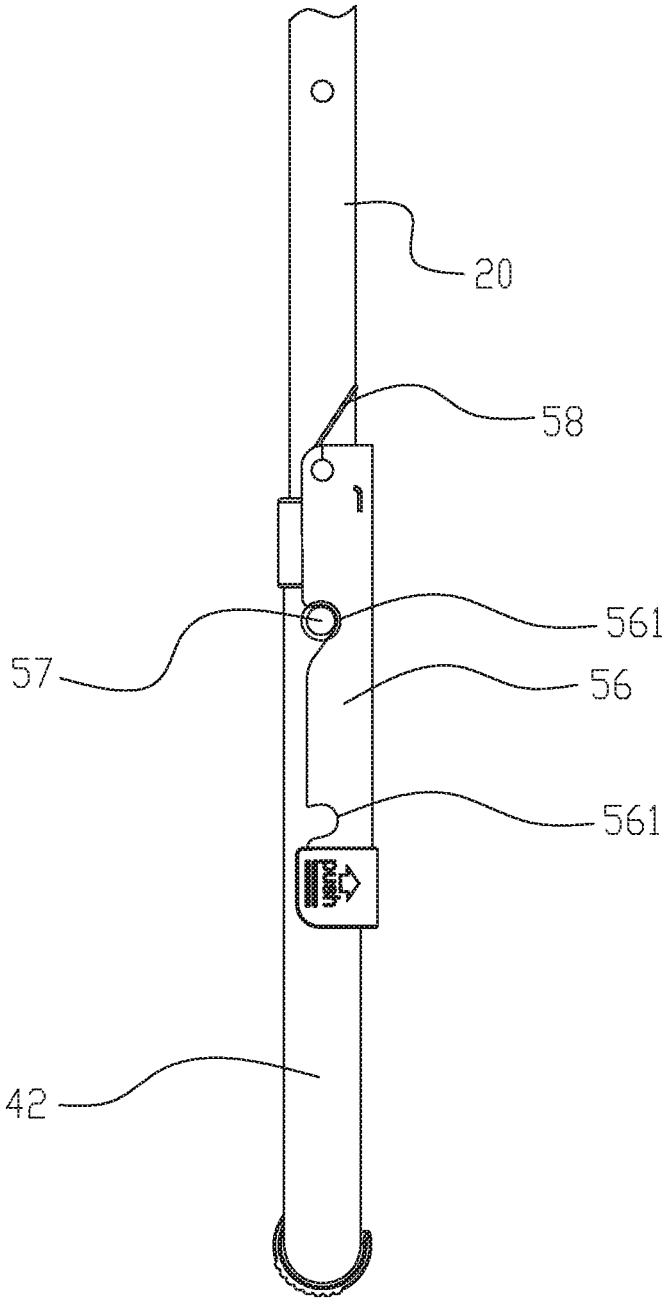
FIG. 11 illustrates a side view of a lock piece and a lock pin of the foldable chair of FIG. 9 when in a locked state.

Referring to FIGS. 9-11, Embodiment 5 differs from Embodiment 1 in that a structure of the locking mechanism 50 is different. In this embodiment, the locking mechanism 50 comprises a lock piece 56, a lock pin 57, and an elastic member 58. Each of the lock pins 57 is disposed on a corresponding one of the support tubes 42 and penetrates the corresponding one of the support tubes 42 radially, and each upper end of the lock pieces 56 is pivotally and rotatably connected to a corresponding one of the leg tubes. Each of the lock pieces 56 comprises one or more third lock holes 561 (e.g., lock grooves) for receiving the lock pin 57. In some embodiments, the one or more third lock holes 561 comprises multiple third lock holes, and the one or more third lock holes 561 are disposed at intervals along a length direction of the lock piece 56. Each of the elastic members 58 drives a corresponding one of the lock pieces 56 to rotate and be buckled to a corresponding one of the leg tubes. At the same time, each of the one or more lock pins 57 is received in one of the third lock holes 561. When the leg tubes are to be unlocked from the support tubes 42, the lock pieces 56 overcome driving forces of the elastic members 58 to rotate, so that the lock pins 57 are separated from the one or more third lock holes 561. Multiple of the one or more third lock holes 561 are arranged at different heights along each of the lock pieces 56, and each of the lock pins 57 is configured to be received into one of the one or more third lock holes 561 to adjust a height of the chair seat 10.

In some embodiments, the elastic member 58 is a torsion spring, the lock piece 56 is a shell structure (e.g., a long shell structure) with a semicircular cross section, and each of the torsion springs surrounds a pivot axis between a corresponding one of the lock pieces 56 and a corresponding one of the leg tubes.

It will be apparent to those skilled in the art that various modifications and variation can be made in the present disclosure without departing from the spirit or scope of the invention. Thus, it is intended that the present disclosure cover the modifications and variations of this invention provided they come within the scope of the appended claims and their equivalents.

What is claimed is:

1. A foldable chair, comprising:

a chair seat, front leg tubes symmetrically disposed on a left side and a right side of the chair seat, rear leg tubes symmetrically disposed on the left side and the right side of the chair seat, and two telescopic frames, wherein:

each of the front leg tubes and a corresponding one of the rear leg tubes disposed on a same side of the chair seat are pivotally connected together, the front leg tubes and the rear leg tubes support the chair seat and enable the chair seat to be turned over and to be folded, the two telescopic frames respectively correspond to the front leg tubes and the rear leg tubes, each of the two telescopic frames comprises two support tubes and a connection tube connected to the two support tubes, the two support tubes of a first of the two telescopic frames are respectively and telescopically coupled with the front leg tubes, the two support tubes of a second of the two telescopic frames are respectively and telescopically coupled with the rear leg tubes, and a locking mechanism is disposed between each of the support tubes and a corresponding one of the front leg tubes and the rear leg tubes.

2. The foldable chair according to claim 1, wherein:

each of the locking mechanisms comprises an elastic protrusion ball head and lock holes, the front leg tubes and the rear leg tubes are disposed in the support tubes, one of the elastic protrusion ball heads is disposed on each of the front leg tubes and each of the rear leg tubes, at least two of the lock holes are disposed on each of the support tubes at intervals along a length direction of the support tubes, and the elastic protrusion ball heads are configured to be locked to the lock holes.

3. The foldable chair according to claim 2, wherein upper openings of the support tubes are disposed with guide sleeves.

4. The foldable chair according to claim 1, wherein:

each of the locking mechanisms comprises an elastic protrusion ball head and lock holes, the support tubes are disposed in the front leg tubes and the rear leg tubes, one of the elastic protrusion ball heads is disposed on each of the support tubes, at least two of the lock holes are disposed on each of the front leg tubes and each of the rear leg tubes at intervals along a length direction of the front leg tubes and the rear leg tubes, and the elastic protrusion ball heads are configured to be locked to the lock holes.

5. The foldable chair according to claim 4, wherein lower openings of the front leg tubes and the rear leg tubes are disposed with guide sleeves.

6. The foldable chair according to claim 1, wherein:

the connection tube is connected to lower ends of the two support tubes, and each of the two telescopic frames is U-shaped.

7. The foldable chair according to claim 1, wherein:

the connection tube is connected to middle portions of the two support tubes, and each of the two telescopic frames is H-shaped.

8. The foldable chair according to claim 1, wherein:

the front leg tubes and the rear leg tubes are disposed in the support tubes, the connection tube is connected to middle portions of the two support tubes, each of the two telescopic frames is H-shaped, each of the locking mechanisms comprises an elastic member, lock rods, and lock holes, at least two of the lock holes are disposed on each of the front leg tubes and each of the rear leg tubes at intervals along a length direction of the front leg tubes and the rear leg tubes, the lock rods are laterally and movably disposed in the connection tubes, and the elastic members drive the lock rods to move laterally and outwardly to enable outer ends of the lock rods to be disposed in corresponding lock holes of the lock holes.

9. The foldable chair according to claim 8, wherein:

each inner end of the lock rods is disposed with a slider, a middle portion of each of the connection tubes is disposed with a button configured to move radially, the buttons and the sliders are provided with inclined surfaces facing each other, and the buttons are pressed to pull the lock rods to move laterally and inwardly.

10. The foldable chair according to claim 1, wherein:

the front leg tubes and the rear leg tubes is disposed in the support tubes, each of the locking mechanisms comprises a lock piece, a lock pin, and an elastic member, one of the lock pins is disposed on each of the support tubes, an upper end of each of the lock pieces is pivotally and rotatably connected to a corresponding one of the front leg tubes or the rear leg tubes, each of the lock pieces is disposed with a set of lock holes corresponding to a corresponding one of the lock pins, lock holes of the set of lock holes are disposed on the lock piece at intervals along a length direction of the lock piece, each of the elastic members drives a corresponding one of the lock pieces to rotate and be buckled to the corresponding one of the front leg tubes or the rear leg tubes, and each of the lock pins is received within a lock hole of a corresponding set of the sets of lock holes concurrently.

11. The foldable chair according to claim 10, wherein:

the elastic member is a torsion spring, the lock piece is a shell structure comprising a semicircular cross section, and the torsion spring surrounds a pivot axis between a corresponding one of the lock pieces and a corresponding one of the front leg tubes or the rear leg tubes.

12. The foldable chair according to claim 11, wherein:

the connection tube is connected to lower ends of the two support tubes, each of the two telescopic frames is U-shaped, and an upper end of each of the two support tubes are disposed with a guide sleeve.

* * * * *